US011395542B2

(12) United States Patent
Zhang

(10) Patent No.: US 11,395,542 B2
(45) Date of Patent: Jul. 26, 2022

(54) SMART DESK AND CHAIR

(71) Applicant: OmniMax USA, LLC, Anna, TX (US)

(72) Inventor: Dabing Zhang, Yangzhou (CN)

(73) Assignee: OmniMax USA, LLC, Anna, TX (US)

( * ) Notice: Subject to any disclaimer, the term of this patent is extended or adjusted under 35 U.S.C. 154(b) by 0 days.

(21) Appl. No.: 16/852,440

(22) Filed: Apr. 18, 2020

(65) Prior Publication Data

US 2020/0329861 A1 Oct. 22, 2020

(30) Foreign Application Priority Data

Apr. 18, 2019 (CN) ..... ZL201920536111.2

(51) Int. Cl.
*A47B 9/00* (2006.01)
*A47C 7/62* (2006.01)

(52) U.S. Cl.
CPC ..... *A47B 9/00* (2013.01); *A47C 7/62* (2013.01); *A47B 2200/0062* (2013.01)

(58) Field of Classification Search
CPC ..... A47B 9/00; A47B 2200/0062; A47B 2200/0066; A47B 2200/007; A47B 2200/0072; A47B 2200/0073; A47B 2200/0076; A47B 2200/0078; A47B 2200/0081
USPC ..... 108/50.01, 50.02; 297/174 R, 135
See application file for complete search history.

(56) References Cited

U.S. PATENT DOCUMENTS 6,425,862 B1 * 7/2002 Brown ..... G06F 19/00 600/300
9,612,849 B1 * 4/2017 Gildein, II ..... H04L 67/34
10,085,562 B1 * 10/2018 Labrosse ..... A47C 7/727
10,827,829 B1 * 11/2020 Labrosse ..... A47B 9/20
2011/0101739 A1 * 5/2011 De Lissandri ..... H04N 7/18 297/135
2014/0137773 A1 * 5/2014 Mandel ..... G06Q 10/109 108/50.11
2014/0208986 A1 * 7/2014 DesRoches ..... A47B 13/081 108/22
2015/0230602 A1 * 8/2015 Glockl ..... G06F 3/1431 108/25
2017/0135587 A1 * 5/2017 Desroches ..... A61B 5/14551
2018/0279770 A1 * 10/2018 Crowe ..... A47B 21/02
2019/0029412 A1 * 1/2019 Gibson ..... A47B 21/02
2019/0053617 A1 * 2/2019 Laudadio ..... F16M 11/2014
2019/0252903 A1 * 8/2019 Lukas ..... H02J 7/0042
2019/0328128 A1 * 10/2019 Namala ..... A47B 9/16
2019/0328129 A1 * 10/2019 Namala ..... A47B 9/16
2020/0054136 A1 * 2/2020 Deveze ..... A63B 24/0062

(Continued)

FOREIGN PATENT DOCUMENTS

CN 2099950747 1/2020

*Primary Examiner* — Jose V Chen
(74) *Attorney, Agent, or Firm* — Frank M. Scutch, III

(57) ABSTRACT

A smart desk and chair includes a desk having at least one lift arm that is expandable and retractable for adjusting the height of a desk surface and a chair having a sensor included inside a chair seat where the sensor detects the presence or absence of a user seated in the chair. A controller in the desk controls the position of the at least one lift arm in the desk. The desk and chair are connected wirelessly enabling the desk surface to be automatically raised or lowered in relation to the floor depending on the standing or seated position of the user.

18 Claims, 4 Drawing Sheets

(56) References Cited

U.S. PATENT DOCUMENTS

2020/0093260 A1* 3/2020 De La Fuente Sanchez ..... A47B 21/02
2020/0104762 A1* 4/2020 Gibson ..... A47C 7/72

* cited by examiner

SMART DESK AND CHAIR

FIELD OF THE INVENTION

The present invention relates generally to office furniture and more particularly to an office desk and chair system having integrated wireless communications for adjusting desk height.

BACKGROUND

When either studying or working, this activity typically requires persons to be seated for an extended periods of time. Because people are seated in only one position, this activity often causes them to feel tired and fatigued which makes working or studying at the desk less efficient. Moreover, the height of a typical desk cannot be easily changed so that people using the desk cannot easily move, change chair height or change their posture to a more comfortable position. For example, people cannot continue to use a desk when at a standing position. This makes long term activities while using the desk much more uncomfortable and inconvenient. Thus, solutions are required that enable people to continue working while changing their posture at a desk.

SUMMARY OF THE INVENTION

This practical new design's goal is to help reduce the fatigue caused by extended periods of seating. This provides a kind of smart desk and chair, and it's capable of changing the height of the table automatically, to adjust to people's preference of seating or standing while they study or work.

In order to achieve the goal, embodiments of the invention provide a type of smart desk and chair where the desk includes a desk surface, one or more lift arms attached to table legs, a wireless signal transceiver and controller. The wireless signal may use Wi-Fi, Bluetooth, Zigbee or other wireless protocols. The desk surface is installed above the lift arm where the lift arm is capable of raising and lowering the desk surface above the floor based on electrical commands. The controller is electrically connected to a wireless signal receiver and at least one lift arm. The controller works to receive a wireless signal receiver/transceiver's signal, and send out electrical controls to be control lift arm position. The chair includes a chair surface, at least one sensor and a wireless signal emitter/transmitter. When the sensor detects the user is seated, it will create an electrical signal communicated over a wireless connection with the chair, which is used by a controller. The controller is used to operate and control one or more of the lift arms to raise or lower the desk surface based upon whether the user is in a standing or seated position.

Preferably, the controller at the desk, includes a control module that controls the lift arm(s) and a control panel used to input control commands. The control module and the control panel are electrically connected so that the control panel can input and save to memory the desk surface's upper and lower height limits. When the sensor is triggered, the controller detects a wireless signal. The lift arm will then rise or ascend to the higher limit and stop. Similarly, when being lowered or descending, it will retract and stop when a lower limit is reached. Using this optimization method, a user can freely set the desk surface upper and lower height limit. In use, when different users with different physical heights use the desk, the desk surface position can be easily changed. More specifically, the desk top height can be adjusted to fit the user's standing height at an upper limit and can also be set to a lower limit while in a seated position.

A control panel includes a raise button used to control the position and/or height of lift arm and a lower button is used to control the lowering of lift arm. An upper limit button is used to save the higher limit and the lower limit button is used to save the lower limit. The save button is used to save these height limits in memory. By using the higher limit button and the lower limit button, the user can easily adjust the desk surface's height above the floor allowing the user to adjust and save a height position based on their preference. By using the higher limit button, lower limit button and save button, the user can conveniently execute a save function allowing adjustment to save height settings at any time.

Further, the control panel includes a manual switch that can turn off the lift arm's automatic raising and lowering functions. By using the manual switch, the user can turn off the chair sensor's control function which controls desk height. This works to prevent desk surface from moving unexpectedly when the user is leaving or standing from the chair. The control panel may also include a liquid crystal display (LCD) that is used to display desk surface height or the control module's status information. With the LCD display, the user can visualize the height of desk surface. When setting up these functions, the user can also use the display to show the controller's current status, to confirm the next step of action, and/or to prevent errors in desk height position. In use, the controller may include a hand control such that the control panel is installed at or near the hand control. Optionally, the hand control can stowed in the chair where it can be easily removed to make operation and movement of the desk more convenient.

In another embodiment, the chair surface has a cushion that can include a sensor, such as a thin film pressure sensor as well as a wireless transmitter. In use, the cushion is separable allowing it to be moved to a different chair allowing a different chair to be used with the current desk where the set-up is easy to initiate and recall. In still another embodiment, the chair's lift arm is configured as an electric push rod lift arm. The electric pushrod lift arm can conveniently be raised or lowered using electric motor. Thus, embodiments of the invention work to conveniently adjust the desk's height for enabling users of different body types and sizes to comfortably adjust the desk chair and desk height for work or study. When a user feels fatigue caused by an extended period of seating, the user can stand up, and the desk will automatically adjust to the user's standing height. This allows the user to maintain a comfortable standing position during work and study.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
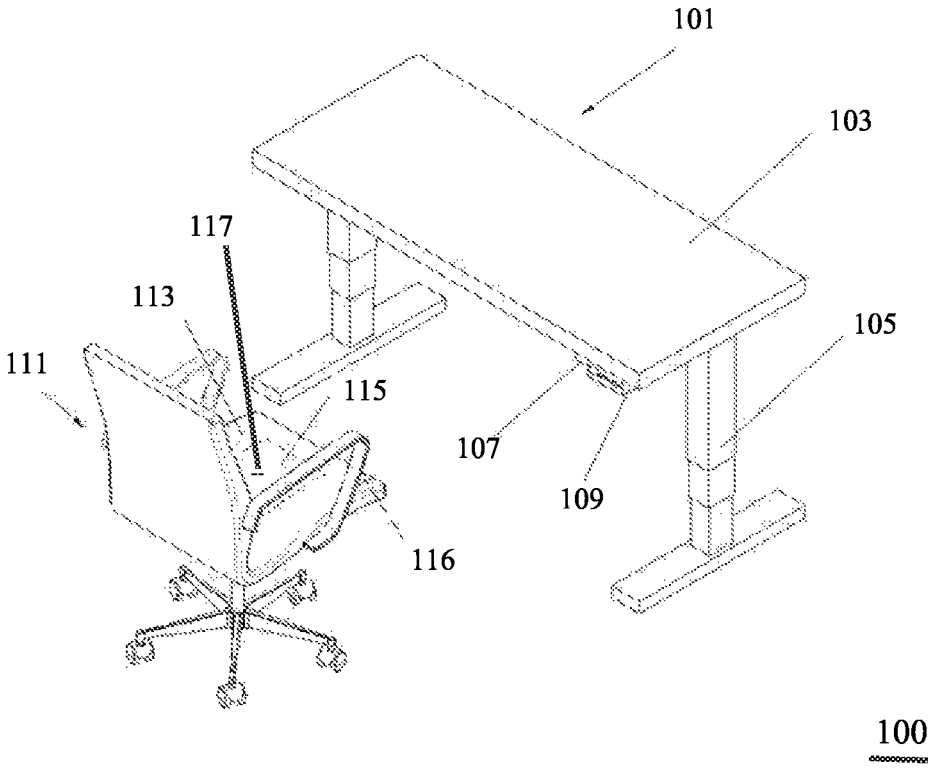
FIG. 1 is a perspective view showing the desk and chair system having integrated communication.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a smart chair and desk system having integrated wireless communications capability. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 4:
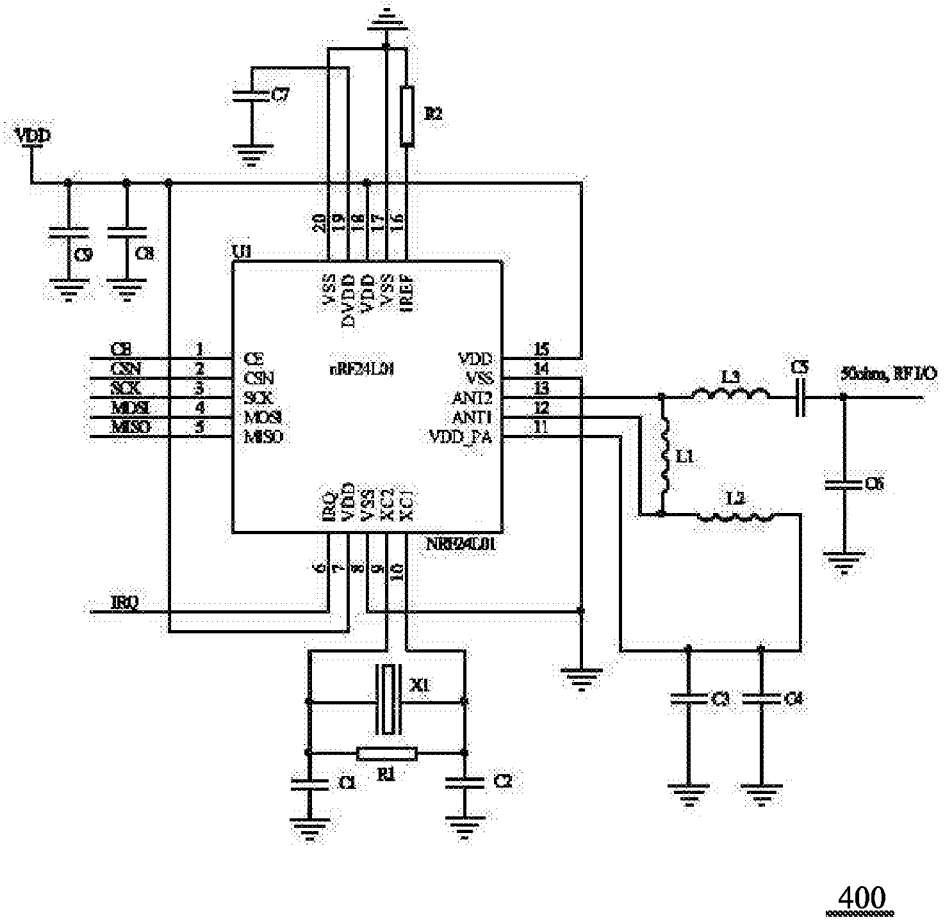
FIG. 4 is a schematic diagram illustrating the wireless receiver.

FIG. 1 is a perspective view showing the desk and chair system 100 having integrated wireless communication. Those skilled in the art will recognize that wireless communication may include but is not limited to Wi-Fi, Bluetooth, Zigbee or other communications standards. Thus, communication may be directly between devices or through a server in the Cloud. According to various embodiments of the invention, the smart desk and chair system 100 includes a desk 101 and chair 103 where the desk 101 includes desk surface 103, lift arms 105, a wireless signal receiver 107 and a controller 109. The desk surface 103 is installed and mechanically connected to the lift arm 105 which enables the desk surface 103 to be raised and lowered. For example, one or both of the lift arms 105 may use a hydraulic lift arm having a hydraulic pump or alternatively an air lift arm which utilizes an air pump. The lift arm 105 acts with the table leg and works by extending or retracting its overall length under electrical command for raising or lowering the desk surface 103. As shown in the schematic of FIG. 4, a wireless signal receiver 107 uses a wireless transceiver module such as an Arduino NRF24L01. The RFI/O is used to receive a 2.4 GHz wireless signal such as that used in a Wi-Fi, Bluetooth, Zigbee or other wireless communications standard. After processing, the transceiver will communicate using a serial peripheral interface (SPI) port and controller 109. The controller 109 uses software control management (SCM) controls allowing the SPI port to electrically connect to wireless signal receiver 107, to receive signals transferred from wireless signal receiver 107. Thus, these circuits are electrically connected to lift arm 105, to send out an electrical command which controls the lift arm's 105 movement and its ability to expand and contract for adjusting height.

The chair 111 includes a chair surface 113, a sensor 117 and a wireless signal transmitter/transceiver 117. A sensor 115 is installed in the chair seat 116 at or near the surface 113. Those skilled in the art will recognize that the sensor 115 may be a pressure sensor, light sensor or ultrasonic sensor, and is electrically connected to wireless signal transmitter 117. For example, the wireless signal transmitter 117 can use an Arduino NRF24L01 wireless transceiver module that is powered by an internal dry battery. When the user is seated in chair 111, the sensor 115 will detect user presence and/or activity and create a activate signal. The activate signal is transferred to the wireless signal transmitter 117, where it sends a signal to the wireless signal receiver 107, then to controller 109. It is the controller 109 that sends out control commands allowing the controlling lift arm(s) 105 to contract and lower overall desk height. When the user leaves the chair 111, it will also trigger sensor 115 to create a signal, where the signal will go through the same electrical route to controller 109. The controller 109 sends out control commands for controlling lift arm(s) 105 to expand and raise the table surface to a predetermined height.

Figure 2:
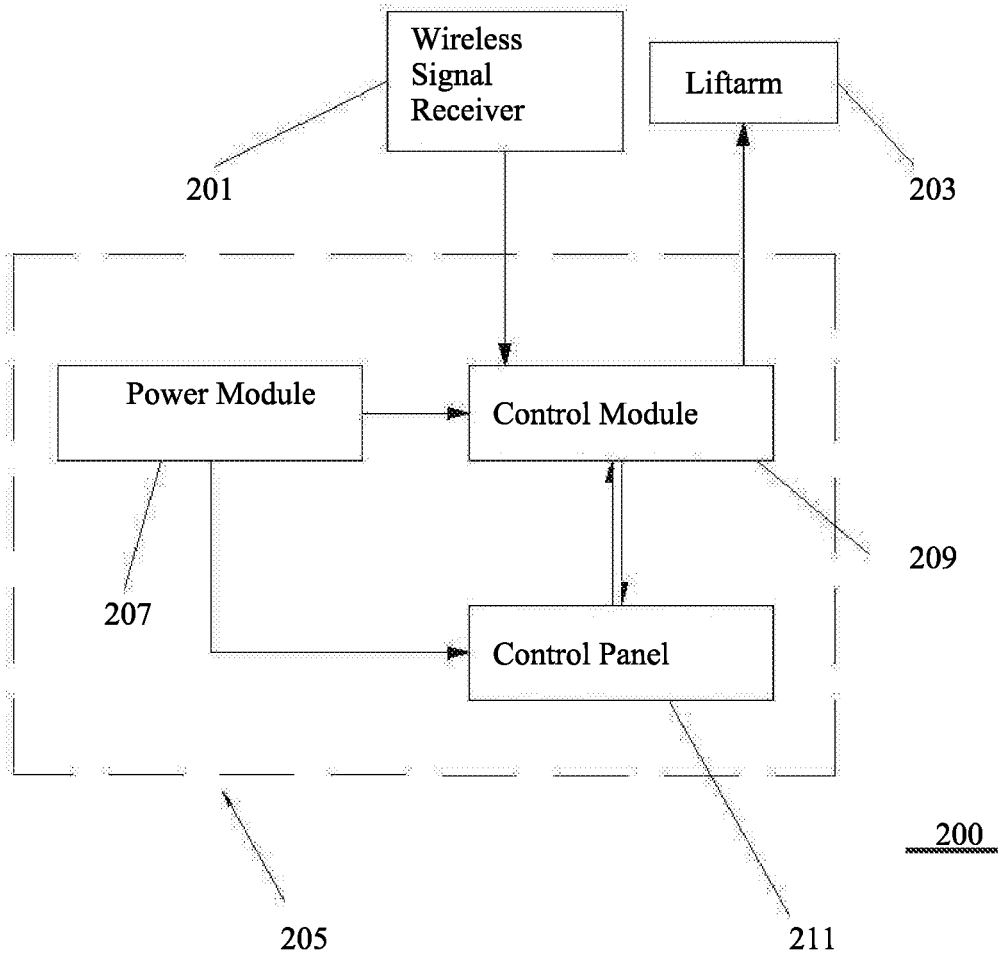
FIG. 2 a block diagram illustrating the control module and control panel.
Figure 5:
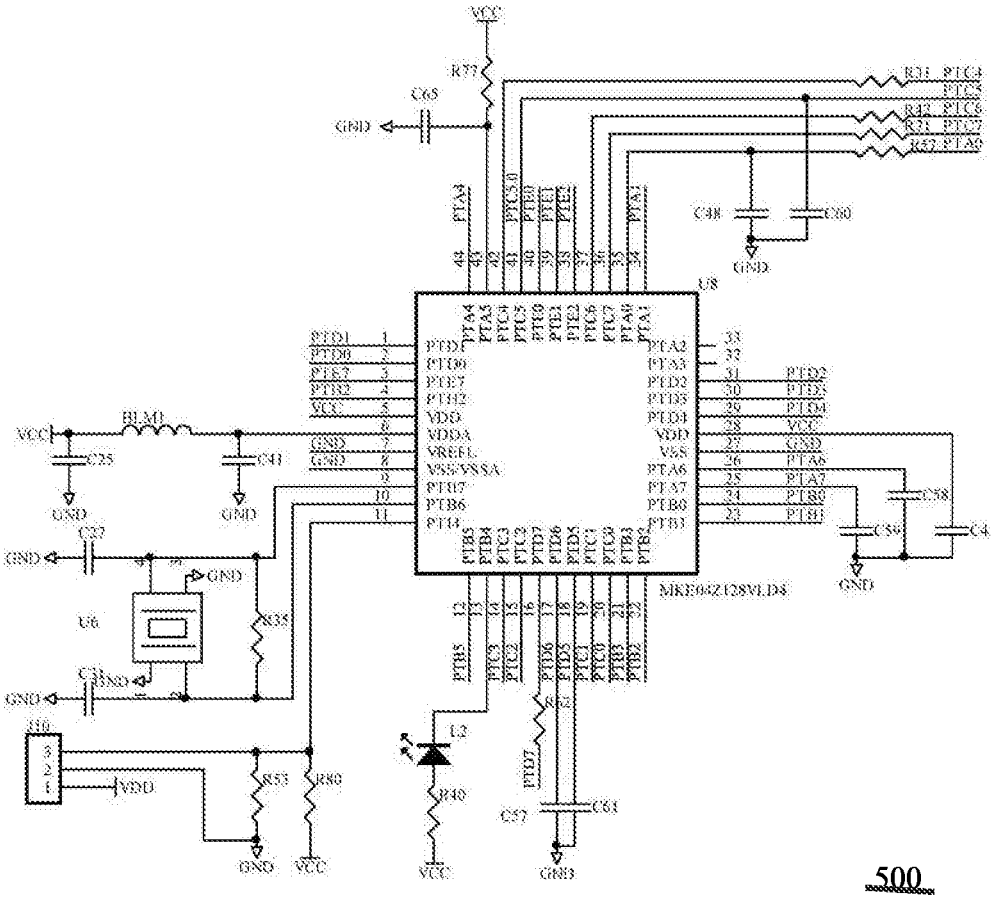
FIG. 5 is a schematic diagram illustrating the control module for the desk and chair system.

FIG. 2 is a block diagram illustrating the control module and control panel used in an embodiment of the invention. The control panel 200 includes a controller 205 as well as a power module 141, control module 142 and a control panel 143. Power module 141 provides power to the control module 207 and the control panel 21. The power module 141 can also provide power to wireless signal receiver 201. As shown in FIG. 5, the control module 209 can use a MKEO4Z128VLD4 SCM device sold by NXP Semiconductors, Inc. to electrically connect a wireless signal receiver 201 for receiving wireless radio frequency (RF) signal such as Wi-Fi, Bluetooth or the like. This device uses a universal asynchronous receiver-transmitter (UART) to connect electrically to the control panel 211. The UART works to receive commands input into the control panel 211. The UART uses pulse width modulation to the control voltages required to operate and control an electric motor. In order to control desk surface height, the control module 209 receives and saves these settings using control panel 211 to control the desk height upper limit and lower limit. When chair seat sensor is actuated, the control module 209 controls the operation of the lift arm 203 to expand its length until desk surface reaches it upper height limit and can lower or retract until desk surface reaches its lower limit height.

Figure 3:
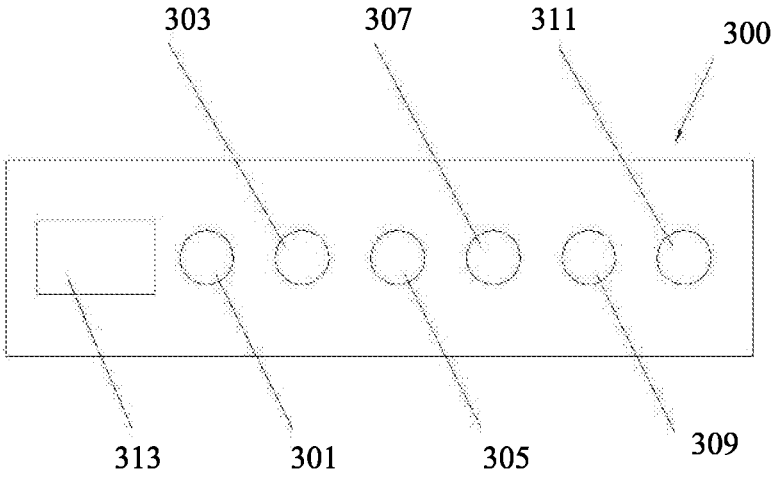
FIG. 3 a perspective view of an example of the control panel.

FIG. 3 a perspective view of an example of the control panel used to provide control inputs in accordance with various embodiments of the invention. The control panel 300 includes a plurality of switches such as raise button 301, lower button 303, a higher limit button 305, a lower limit button 307 and a "save" button 309. When the raise button 301 is pressed, it activates the control module to send control information to one or more of the legs or lift arms activating them to extend. When the lower button 303 is pressed, this activates the control module to send control information to the lift arm(s) to lower the table top or table surface. If the save button 309 is pressed once, the control module enters a "pre-save" mode. Next, the user can press the high limit button 305 and the controller will save to memory the current height position of the desk at this upper limit. Similarly, the user can lower the desk surface and when the lower limit button 307 is pressed, the controller will save to memory the current surface height of desk to this lower limit. The user will press the save button 309 an additional time where the control module will automatically exit the pre-save mode.

The control panel 300 further includes a manual button 311. When the manual button 311 is pressed, the control module will switch between a manual control mode and the "auto" mode. When control module is in manual mode, the sensor will transmit a command or control signal to one or more of the lift arms. When the user stands from the chair, the height of desk surface will not automatically raise. Instead, the user can only adjust the height of desk surface using the raise button 301 and lower button 303. The control panel 300 may also include a liquid crystal display (LCD) 313 where the LCD display 313 is used to display desk surface height, and display the current mode of the control module e.g. when the mode of the control module has been changed.

As noted above, FIG. 4 is a schematic diagram illustrating the wireless receiver used at the desk.

As noted above, FIG. 5 is a schematic diagram illustrating the control module used at the chair.

In another embodiment, the controller may include a manual controller where the control panel 300 is installed on the manual controller. The controller parts are installed in a controller box where the controller box is installed under the desk surface. A hand controller might also be connected to the controller box via a wired connection. Similarly, the hand controller can be a portable device such as a smart phone or other separate unit that can stowed and/or installed under the desk surface near the edge of the desk. The hand controller can be configured so it can be easily removed when necessary, and can be replaced and stowed back under the desk surface when the user is finished using the hand controller. In the case of a mobile telephone or other portable device, it can be used to control and adjust height of the desk using the appropriate software application.

In still other embodiments of the invention, the sensor used in the chair is a pressure sensor that operates by sensing a pressure or user weight on chair surface which indicates if a user has seated. In other embodiments, the chair has a cushion installed sensor and wireless transmitter that is installed inside the cushion. When the user sits on the cushion stands from the cushion, this will actuate the sensor which subsequently triggers the controller The sensor may be a thin film pressure sensor that is installed at or under the chair surface. In other embodiments, the lift arm uses electric push rod lift arm. where the controller is electrically connected to the electric push rod lift arm. The controller uses PWM to control voltages that controls operation of one or both of the lift arms enabling them to expand and retract.

In summary, this convenient new design of the smart desk and chair system has sensors installed in the chair enabling the standing or sitting position of the user to be determined. When the user seats down, a sensor enables a wireless transmitter. This signal is detected by a wireless receiver which indicates position of the signal to a controller. The controller then enables one or more of the lift arms which enables the desk surface to be raised or lowered depending on user position. More specifically, when the user stands up, this is detected by the sensor which sends a signal to enable the controller to raise the desk height to the user's standing position or some other upper height limit stored in memory. When the user sits down, this is also detected by the sensor so that the desk height is lowered to the user's sitting position or some other predetermined lower limit stored in memory. Therefore this convenient and new smart desk and chair system can automatically adjusts its height to fit with user's standing or seating position. This prevent fatigue so the user need not stay in one seated position for extended periods of time.

As described herein, this convenient new design uses a control panel that is set up to help the user conveniently adjust the surface upper and lower height limits of the desk surface. Thus, the desk and chair system can be used to adapt to users having different physical heights. Through visualization, the control panel includes buttons and LCD display for making setup and adjustment of the desk surface height more convenient. Further, the controller can include a hand controller or mobile phone interface so that control can be separated from desk surface. A thin film pressure sensor makes the detection of user's seating information more accurate and precise, at the same time providing a more comfortable experience. By installing the sensor and wireless signal transmitter inside the cushion, this allows the user to change to a different chair without affecting the height of the desk. The invention also employs use of an electric push rod lift arm that makes for a more simple construction while reducing overall noise and the requirement for lubricants.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. A smart desk and chair comprising:

a desk having at least one lift arm that is expandable and retractable for adjusting the height of a desk surface;

a chair having a sensor included inside a removeable chair seat cushion where the sensor is located at an upper surface of the cushion and detects the presence or absence of a user seated in the chair;

a detachable controller for controlling a position of the at least one lift arm and having dedicated controls for setting an upper height limit and lower height limit, where the detachable controller is stowed in the chair and includes a display indicating desk surface height to the user; and wherein the desk and chair are connected wirelessly enabling the desk surface to be automatically raised or lowered in relation to the floor depending on the standing or seated position of the user.

2. A smart desk and chair as in claim 1, where the controller can save a position of the at least one lift arm that corresponds to an upper limit and lower limit of the desk surface.

3. A smart desk and chair as in claim 1, wherein the chair sends a signal to the desk when the sensor detects the user is no longer seated in the chair for raising the desk surface to a predetermined standing height.

4. A smart desk and chair as in claim 1, wherein the chair sends a signal to the desk when the sensor detects the user is seated to lower the desk to a predetermined seated height.

5. A smart desk and chair as in claim 1, wherein the chair includes a control panel having at least one control button for adjusting the height of the desk surface.

6. A smart desk and char as claim 5, wherein the control panel includes a display for indicating status information of the controller.

7. A smart desk and chair as in claim 1, wherein the controller is configured inside a hand controller that is separated from the chair.

8. A smart desk and chair as in claim 1, wherein the at least one sensor is a thin film pressure sensor.

9. A smart desk and chair system as in claim 1, wherein the wireless connection uses a Bluetooth standard.

10. A smart desk and chair for enabling a user to automatically adjust desk surface height comprising:

a desk having at least one lift arm using a controller to expand or retract a position of a desk surface;

a chair having a sensor included in located at an upper surface of a removeable chair seat cushion where a sensor detects the presence or absence of a user seated in the chair;

a wireless remote stored within an arm of the chair and detachable from the chair for enabling a user to control a position of the at least one lift arm and including dedicated controls for setting upper limit and lower height limits of the desk; and wherein the desk surface height is automatically controlled and displayed to the user based on user position with regard to the seating or standing position of the user.

11. A smart desk and char as in claim 10, where the controller can save-a position of the at least one lift arm that corresponds to an upper limit and lower limit of the desk surface.

12. A smart desk and chair as in claim 10, wherein the chair sends a signal to the desk when the sensor detects the user is no longer seated in the chair for raising the desk surface to a predetermined standing height.

13. A smart desk and chair as in claim 10, wherein the chair sends a control signal to the desk when the sensor detects the user is seated to lower the desk to a predetermined seated height.

14. A smart desk and char as claim 10, wherein the controller includes a display for indicating desk height status information.

15. A smart desk and chair as in claim 10, wherein the at least one sensor is a thin film pressure sensor.

16. A smart desk and chair system as in claim 10, wherein the wireless connection uses a Bluetooth standard.

17. A smart desk and chair that automatically adjusts desk surface height comprising:

a desk having at least one lift arm that are expandable and retractable for adjusting a height of the desk surface above the ground;

a chair having a sensor located at an upper surface of the cushion included in a removeable chair seat cushion where the sensor detects the presence or absence of a user seated in the chair;

a detachable controller stowed in an arm of the chair having a display indicating desk surface height to the user where the controller is configured with the desk for controlling a position of the at least one lift arm and including dedicated controls for setting upper and lower height limits of the desk;

a display configured with the desk for indicating desk height status information; and wherein the desk and chair are connected wirelessly, and the upper and lower limits of the desk surface position are saved for enabling the desk surface to be automatically raised or lowered to the upper and lower limits depending on the standing or seated position of the user.

18. A smart desk and chair system as in claim 17, wherein the wireless connection uses a Bluetooth standard.

* * * * *